United States Patent [19]

Theurer et al.

[11] Patent Number: 4,858,696

[45] Date of Patent: Aug. 22, 1989

[54] MOBILE BALLAST CLEANING MACHINE

[75] Inventors: Josef Theurer, Vienna; Manfred Brunninger, Altenberg, both of Austria

[73] Assignee: Franz Plasser Bahnbaumaschinen-Industriegesellschaft m.b.H., Vienna, Austria

[21] Appl. No.: 158,793

[22] Filed: Feb. 22, 1988

[30] Foreign Application Priority Data

Mar. 31, 1987 [AT] Austria ..... 784/87

[51] Int. Cl.[4] ..... E01B 27/00

[52] U.S. Cl. ..... 171/16

[58] Field of Search ..... 171/16, 19, 97; 37/104, 37/105, 106, 107

[56] References Cited

U.S. PATENT DOCUMENTS

| | | | |
|---|---|---|---|
| 3,380,180 | 4/1968 | Speno | 37/105 |
| 3,436,848 | 4/1969 | Peppin et al. | 171/16 |
| 3,457,660 | 7/1969 | Speno | 37/105 |
| 4,635,664 | 1/1987 | Theurer et al. | 134/131 |
| 4,674,208 | 6/1987 | Whitaker, Jr. | 171/16 |
| 4,705,115 | 11/1987 | Whitaker, Jr. | 171/16 |

FOREIGN PATENT DOCUMENTS

| | | | |
|---|---|---|---|
| 1224375 | 4/1986 | U.S.S.R. | 171/16 |

*Primary Examiner*—Robert E. Garrett
*Assistant Examiner*—Therese M. Newholm
*Attorney, Agent, or Firm*—Kurt Kelman

[57] ABSTRACT

A machine for cleaning ballast along the shoulders of a railroad track, which comprises a machine frame, an endless ballast excavating and conveying chain vertically adjustably mounted at each machine frame side, a ballast screening installation arranged to receive the excavated ballast conveyed by the endless chains, and a ballast loosening and excavating device preceding each endless ballast excavating and conveying chain in the operating direction of the machine and vertically adjustably mounted on the machine frame. Each device includes a ballast loosening and excavating tool arranged to project below a respective tie end in a vertically adjusted operating position and a ballast guide plate arranged adjacent the tool for receiving the loosened and excavated ballast therefrom and guiding it transversely outwardly from the tie end whereby a ballast heap spaced from the tie end in longitudinal alignment with each chain is produced for excavation and conveyance by the chain.

5 Claims, 1 Drawing Sheet

MOBILE BALLAST CLEANING MACHINE

BACKGROUND OF THE INVENTION (1) Field of the Invention

The present invention relates to a machine for cleaning ballast along the shoulders of a railroad track mounted on the track for mobility in an operating direction, the track consisting of two rails fastened to ties having transversely opposite ends at the track shoulders, which comprises a machine frame having transversely opposite sides adjacent the track shoulders, a respective endless ballast excavating and conveying chain vertically adjustably mounted at a respective one of the machine frame sides, a ballast screening installation arranged to receive the excavated ballast conveyed by the endless chains, and a respective ballast loosening and excavating device vertically adjustably mounted on the machine frame, each device including a ballast loosening and excavating tool arranged to project below a respective one of the tie ends in a vertically adjusted operating position and ballast guide plate means arranged adjacent the tool.

(2) Description of the Prior Art

Mobile ballast cleaning machines of this type have been used on tracks over which coal is transported. The ballast in the shoulders of such tracks becomes very dirty because of the accumulation of coal dust settling thereon as such coal dust trickles from the passing freight cars in which the coal is transported. This encrustation of the ballast bed causes drainage problems. In the known mobile ballast cleaning machines, the dirty shoulder ballast is excavated by the endless chains at the sides of the machine frame and conveyed to a trailing ballast screening installation where it is cleaned. The ballast loosening and excavating device trails the endless ballast excavating and conveying chain in the operating direction and serves to scrape and remove the dirty ballast in the range of the tie end, which has not been excavated by the chain which is transversely spaced from the tie end. This ballast is guided by a guide plate transversely outwardly from the tie end into the area of the track shoulder previously excavated by the chain and partially fills this excavated track shoulder area. A ballast distributing chute follows the ballast loosening and excavating device in the operating direction to discharge the cleaned ballast in this partially filled track shoulder area. This has the disadvantage that the dirty ballast loosened and excavated from under the tie ends is mixed with the cleaned ballast so that the ballast shoulders still contain coal dust-contaminated ballast.

U.S. Pat. No. 4,635,664, dated Jan. 13, 1987, discloses a mobile machine for cleaning ballast along the shoulders of a railroad track, wherein the dirty ballast excavated along the shoulders is conveyed to a washing installation and the washed ballast is then conveyed to a ballast screening installation. This washed and screened ballast is then redistributed in the excavated shoulder areas and smoothed by means of a ballast plow. However, this machine is not well adapted for use with coal dust-contaminated ballast because the coal dust is merely smeared over the ballast in the washing installation and cannot be removed therefrom in the succeeding screening installation.

SUMMARY OF THE INVENTION

It is the primary object of this invention to improve a mobile ballast cleaning machine of the first-described type so that fully cleaned railroad track shoulders can be obtained while retaining well-proven ballast cleaning devices.

The above and other objects and advantages are accomplished with such a machine according to the invention by arranging each ballast loosening and excavating device so that it precedes a respective endless ballast excavating and conveying chain in the operating direction, and ballast guide plate means is so arranged adjacent the tool that it receives the loosened and excavated ballast therefrom and guides it transversely outwardly from the tie end whereby a ballast heap spaced from the tie end in longitudinal alignment with the respective chain is produced for excavation and conveyance by said chain.

This special arrangement of the ballast loosening and excavating device has the great advantage that the loosened and excavated dirty ballast is transversely guided outwardly into a location spaced from the tie end where it is received by the succeeding ballast excavating and conveying chain for conveyance to the ballast screening installation. Therefore, a completely cleaned ballast is redistributed to the excavated track shoulder area for forming a homogeneous ballast bed which may be drained without problem. Furthermore, since the dirty ballast is transversely moved outwardly from the excavated tie end, the succeeding ballast excavating and conveying chain may be spaced farther from the machine frame side in longitudinal alignment with the dirty ballast heap, which enables the machine to move faster along the track and enhances the operating efficiency of the excavating and conveying chain.

BRIEF DESCRIPTION OF THE DRAWING

The above and other objects, advantages and features of the present invention will become more apparent from the following detailed description of a now preferred embodiment thereof, taken in conjunction with the accompanying drawing wherein.

DETAILED DESCRIPTION OF PREFERRED EMBODIMENT

Figures 1, 2, 3, 4, 5:
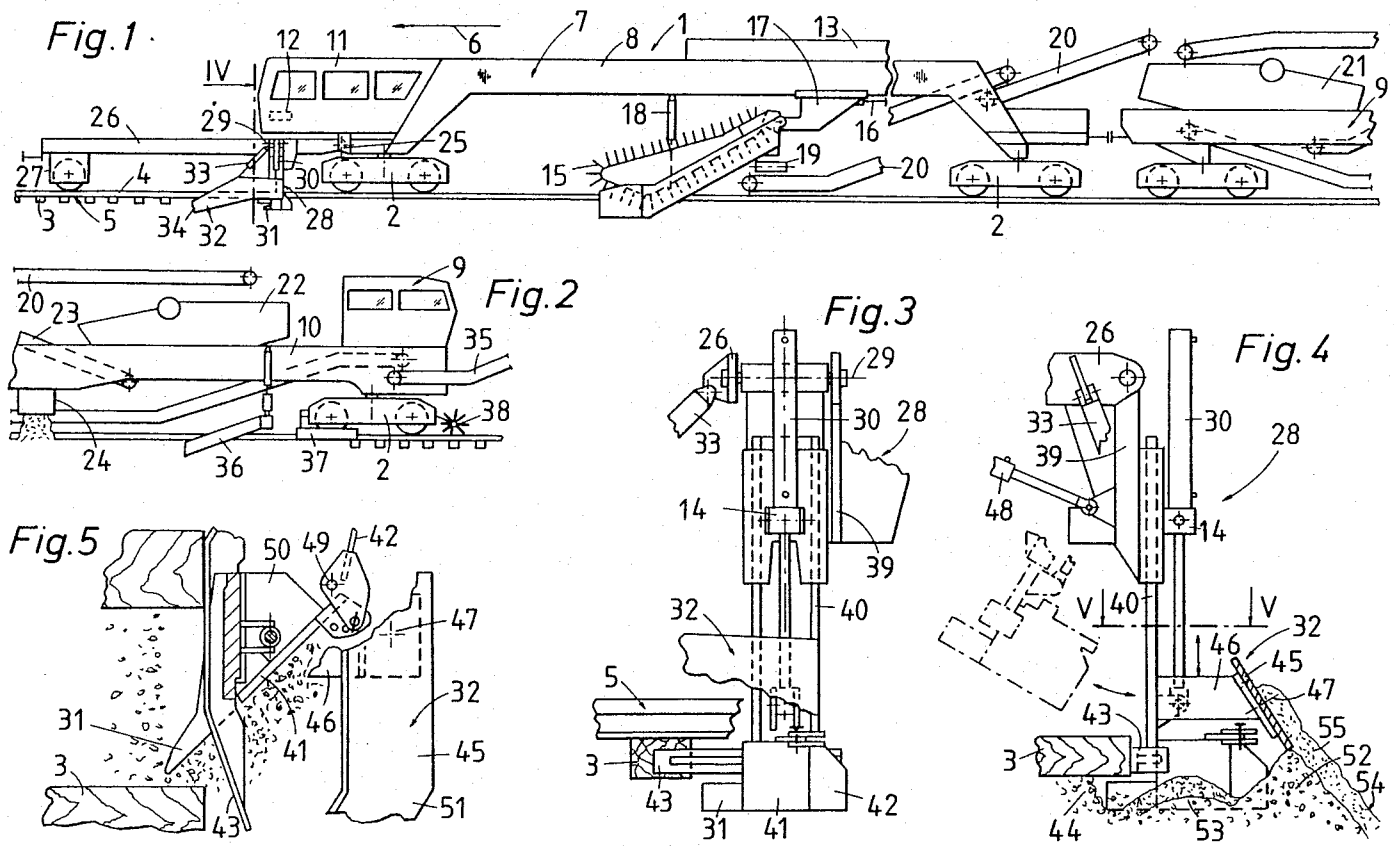
FIGS. 1 and 2 show a generally schematic side elevational view of a mobile machine for cleaning ballast along the shoulders of a railroad track, FIG. 2 being a continuation of FIG. 1 and illustrating the rear end of the machine.
FIG. 3 is an enlarged side elevational view showing the ballast loosening and excavating device.
FIG. 4 is an enlarged end view of the device, taken along line IV of FIG. 1.
FIG. 5 is an enlarged top view of the device, partially in cross section along line V—V of FIG. 4.

Referring now to the drawing and first to FIGS. 1 and 2, there is shown machine 1 for cleaning ballast along the shoulders of railroad track 5 consisting of two rails 4 fastened to ties 3 having transversely opposite ends at the track shoulders. The machine is mounted on track 5 for mobility in an operating direction indicated by arrow 6. It comprises leading work vehicle 7 with machine frame 8 having transversely opposite sides adjacent the track shoulders and trailing work vehicle 9 with machine frame 10 coupled to the leading work vehicle. Operator's cab 11 is mounted on the front end of leading work vehicle 7 and power plant 13 is mounted on the rear end thereof. Control panel 12 in cab 11 is connected to the power plant and to the operating drives of the machine to enable an operator in the cab to control the operation of the drives. Machine frame 8 is supported by two undercarriages 2, 2 on track rails 4 and respective endless ballast excavating and conveying chain 15 is vertically adjustably mounted at a respective side of machine frame 8. The ballast excavating and conveying chain is pivotally mounted on support 17, which is longitudinally displaceably mounted on machine frame 8, and power-actuated drive 16 connects support 17 to machine frame 8 for displacing the support in the longitudinal direction of the machine frame. A power-actuated vertical adjustment drive 18 links each ballast excavating and conveying chain to machine frame 8 for independent vertical adjustment of each chain 15. A short conveyor band 19, which extends transversely to the longitudinal direction of machine frame 8, is arranged below an upper discharge end of each ballast excavating and conveying chain 15 to convey the excavated dirty ballast conveyed by the chain and discharged therefrom at the upper end to a central conveyor band arrangement 20 leading to a ballast screening installation arranged to receive the excavated ballast conveyed by each endless chain 15. In the illustrated embodiment, the ballast screening installation comprises two successively arranged vibratory ballast cleaning screens 21, 22 inclined towards each other in V-formation for a central discharge of the cleaned ballast. Cleaned ballast collecting conveyor band 23 is mounted centrally between the two ballast cleaning screens for conveying the discharged cleaned ballast to ballast redistributing chutes 24 arranged to discharge the cleaned ballast in the track shoulders.

According to this invention, a ballast loosening and excavating device 28 precedes each endless ballast excavating and conveying chain 15 in the operating direction and is vertically adjustably mounted on machine frame 8. In the illustrated embodiment, a respective device 28 is vertically adjustably mounted below cab 11 at a respective side of an auxiliary frame 26 preceding machine frame 8 of leading work vehicle 7 in the operating direction and this auxiliary frame supports ballast loosening and excavating devices 28. The auxiliary frame has a rear end pivotally connected to machine frame 8 at pivot 25, and undercarriage 27 supports a front end of auxiliary frame 26 on track rails 4. This arrangement enables the ballast loosening and excavating devices to be retrofitted on existing mobile ballast cleaning machines without interfering with the trailing ballast excavating and conveying chains while assuring a secure and stable mounting of these devices on machine 1. Furthermore, the pivotal coupling of the auxiliary frame rear end to machine frame 8 and the support of its front end on the track assures an automatic centering of devices 28 with respect to the tie ends. Power-actuated pivoting drive 48 links device 28 to auxiliary frame 26 for pivoting the device in a transverse vertical plane about axis 29 extending in the longitudinal direction of machine frame 8. Each device 28 includes a nose-shaped ballast loosening and excavating tool 31 arranged to project below a respective tie end in a vertically adjusted position, and ballast guide plate means 41, 42 (see FIGS. 3 and 5) arranged adjacent tool 31 for receiving loosened and excavated ballast 44 therefrom and guiding it transversely outwardly from the tie end whereby ballast heap 52 spaced from the tie end in longitudinal alignment with respective chain 15 is produced for excavation and conveyance by the chain (see FIGS. 4 and 5).

Ballast plow 32 is pivoted to each ballast loosening and excavating device 28 and has a forward end 34 arranged to dig furrow 53 into the ballast at a distance from the tie end (see FIG. 4). The ballast guide plate means comprises ballast guide plate 41 adjoining ballast loosening and excavating tool 31, and ballast plow 32 is spaced from this ballast guide plate. The ballast plow has a rear end 45 extending in the longitudinal direction of the machine and inclined towards ballast loosening and excavating device 28 (see FIG. 4), the angle of inclination of the ballast plow rear end preferably being about 60°. Such a ballast plow laterally spaced from the ballast loosening and excavating device will assure a free outward flow of the loosened and excavated ballast and prevent its jamming at the tie ends. Such ballast jamming will not only cause increased stress on the support of the ballast loosening and excavating device but will also cause the dirty ballast to be deposited on the tie ends. Furthermore, the prevention of such ballast jamming will considerably enhance the effectiveness of devices 28 in loosening and excavating the dirty ballast under the tie ends. The inclined arrangement of the rear end of the ballast plow, particularly at the preferred angle of inclination, will safely prevent the dirty ballast dug up from the furrow in the track shoulder from falling back into that area.

The structure of ballast loosening and excavating device 28 and ballast plow 32 is shown in detail in FIGS. 3 to 5. Device 28 comprises carrier frame 39 pivoted to a side of auxiliary frame 26 for pivoting about axis 29 and carrier plate 40 vertically adjustably mounted on the carrier frame. The cylinder of cylinder-and-piston drive 30 is linked to carrier frame 39 by holding bracket 14 while an outer end of piston rod is affixed to a lower end of carrier plate 40 for vertically adjusting the carrier plate. Ballast loosening and excavating tool 31 and ballast guide plates 41, 42 are mounted on the lower carrier plate end. A pressure pad support 43 is mounted on carrier plate 40 immediately above tool 31 for contacting engagement with the end faces of ties 3 so that, as shown in FIGS. 4 and 5, nose-shaped tool 31 will project inwardly below the tie end and will be held in this operating position during operation of the machine for loosening and excavating dirty ballast 44. Inclined rear end 45 of ballast plow 32 is supported on carrier plate 40 by bracket 46. Drive 33 connects ballast plow 32 to auxiliary frame 36 for pivoting the plow with respect to bracket 46 about axis 47. Pivoting device 28 about axis 29 by pivoting drive 48 in a transverse vertical plane after carrier plate 40 has been raised above the track level by vertical adjustment drive 30 enables the device to be moved into a rest position indicated in chain-dotted lines in FIG. 4 while machine 1 is moved between operating sites. This arrangement enables device 28 with plow 32 to be rapidly moved between a rest and operating position and the vertical adjustability of the ballast plow makes it possible to adapt the depth of furrow 54 quickly to prevailing ballast conditions.

As best shown in FIG. 5, a front face of ballast loosening and excavating tool 31 and a front face of adjoining ballast guide plate 41 define an inclined plane enclosing a dihedral angle of about 45° with a plane extending in the longitudinal direction of the machine and in which pressure pad support 43 extends. Support plate 50 connects guide plate 41 to carrier plate 42 and outer ballast guide plate 42 is pivoted to guide plate 41 for pivoting about vertical axis 49. Leading end 51 of the ballast plow is inclined towards adjacent rail 4 of track 5 and terminates in furrow digging end 34 of the plow adjacent the tie end.

As shown in FIG. 2, trailing work vehicle 9 also carries conveyor band 35 arranged for removing waste discharged from the ballast screening installation and shoulder plow 36 for profiling the ballast in the track shoulder. Immediately preceding rear undercarriage 2 of this work vehicle, a horizontal ballast stripping element 37 is arranged to push off any ballast deposited on the tie end. Furthermore, vertically adjustable, rotatable ballast broom 38 extending over the width of the track is mounted at the rear end of machine 1.

The operation of ballast cleaning machine 1 will partly be obvious from the above description of its structure and will now be described in detail:

After the machine has reached the section of track 5 whose shoulder ballast is dirty and is to be cleaned, ballast excavating and loosening devices 28 at each side of the machine are pivoted by their power-actuated rives 48 from their retracted positions shown in chain-dotted lines in FIG. 4 to their operative positions. Vertical adjustment drive 30 is then actuated to lower ballast loosening and excavating tool 31 and ballast guide plates 41 and 42 into engagement with the ballast at the track shoulders. Outer ballast guide plate 42 is pivoted with respect to fixed guide plate 41 by an angle dependent on the desired distance of ballast heap 52 from track 5 and is held in the adjusted position by a bolt. Power-actuated drives 33 are then actuated to lower shoulder plow 32 until forward end 34 of the plow is at the desired level for digging ditch 53. While all of these adjustments are made, vertical adjustment drives 18 may be actuated to lower transversely opposite endless ballast excavating and conveying chains 15 into engagement with the ballast at the track shoulders, and the chains are set into rotation by suitable drives so as to excavate the ballast and convey the excavated ballast. Also, the drives for ballast conveyor bands 19, 20, 23, 35 as well as the vibrating drives for ballast screens 21, 22 are actuated so that the excavated ballast is conveyed to the screening installation and screened, the cleaned ballast component is redistributed from the screening installation to the track bed and the waste component is removed from the screening installation.

As soon as machine 1 is advanced in the operating direction indicated by arrow 6, forward ends 34 of shoulder plows 32 will dig longitudinally extending ditch or furrow 53 alongside track rails 4, the dirty ballast removed from this furrow being pushed by inclined plow end 51 and trailing plow portion 45 laterally outwardly in the direction of flanks 54 of the track shoulders. As can be seen in FIG. 4, particularly dirty ballast portion 55 is held away from ballast loosening and excavating tool 31 and ballast guide plates 41, 42 during this lateral outward movement of the ballast. The two ballast guide plates 41, 42 are advanced in furrow 53 in the operating direction indicated by arrow 6 and thereby guide the ballast excavated by tool 31 from under the tie ends in the direction of ballast heap 52. In this manner, this ballast portion, which also is particularly dirty, is also pushed laterally outwardly in the direction of flanks 54 of the ballast shoulders, where it is then received with the remainder of the excavated dirty ballast by succeeding ballast excavating and conveying chains 15 which are in alignment with ballast heaps 52. Outwardly displaced dirty ballast 55 removed from furrows 53 is held apart from guide plates 41, 42 by inclined plow portion 45 so that these guide plates may guide the dirty ballast excavated by tool 31 outwardly to heap 52 without interference. The dirty ballast 55 slides down the rear edge of inclined plow portion 45 onto heap 52. In this way, ballast loosening and excavating devices 28 displace the entire dirty ballast from under the tie ends and the shoulders towards shoulder flanks 54 where it is taken up by endless excavating and conveying chains 15 for cleaning in the conventional manner. The combination of ballast plows 32 with devices 28 for digging furrows 53 ahead of ballast guide plates 41, 42 avoids possible jamming of the excavated dirty ballast.

The high-capacity screening installation 21, 22 cleans the excavated ballast effectively, and the cleaned ballast is returned to the excavated track shoulder areas through chutes 24 and the shoulder flanks are then properly profiled by succeeding plow 36. Wiper elements 37 then remove excess ballast above the level defined by the ties and distribute the same uniformly. Any ballast remaining on top of the ties is swept into the cribs by rotary broom 38.

What is claimed is:

1. A machine for cleaning ballast along the shoulders of a railroad track mounted on the track for mobility in an operating direction, the track consisting of two rails fastened to ties having transversely opposite ends at the track shoulders, which comprises (a) a machine frame having transversely opposite sides adjacent the track shoulders, (b) a respective endless ballast excavating and conveying chain vertically adjustably mounted at a respective one of the machine frame sides, (c) a ballast screening installation arranged to receive the excavated ballast conveyed by the endless chains, and (d) a respective ballast loosening and excavating device preceding each endless ballast excavating and conveying chain in the operating direction and vertically adjustably mounted on the machine frame, each device including (1) a vertically extending ballast loosening and excavating tool arranged to project full into the ballast below a respective one of the tie ends in a vertically adjusted operating position for loosening and excavating a layer of the ballast below the one tie end, and (2) ballast guide plate means comprising a ballast guide plate adjoining the ballast loosening and excavating tool for receiving the loosened and excavated ballast therefrom and guiding it transversely outwardly from the tie end whereby a ballast heap spaced from the tie end in longitudinal alignment with the respective chain is produced for excavation and conveyance by said chain, and (e) a ballast plow pivoted to each ballast loosening and excavating device and spaced from the ballast guide plate, the plow having a forward end arranged to dig a furrow into the ballast at a distance from the tie end.

2. The mobile ballast cleaning machine of claim 1, further comprising an auxiliary frame preceding the machine frame in the operating direction and supporting the ballast loosening and excavating devices, the auxiliary frame having a rear end pivotally connected to the machine frame, and an undercarriage supporting a front end of the auxiliary frame on the track rails.

3. The mobile ballast cleaning machine of claim 1, wherein the ballast plow has a rear end extending in the longitudinal direction of the machine and inclined upwardly towards the ballast loosening and excavating device.

4. The mobile ballast cleaning machine of claim 3, wherein the angle of inclination of the ballast plow rear end is about 60°.

5. The mobile ballast cleaning machine of claim 1, wherein the ballast plow is vertically adjustable with respect to the ballast loosening and excavating device, and further comprising a power-actuated drive for pivoting the plow with the device about an axis extending in the longitudinal direction of the machine.

* * * * *

UNITED STATES PATENT OFFICE

CERTIFICATE OF CORRECTION

Patent No. 4,858,696 Dated August 22, 1989

Inventor(s) Josef THEURER and Manfred BRUNNINGER

It is certified that error appears in the above-identified patent and that said Letters Patent is hereby corrected as shown below:

Cover page, column 1, item [73], lines 2 and 3, delete "Industriegesellsl-chaft" and substitute therefor --Industriegesellschaft--.

Signed and Sealed this

Fourteenth Day of August, 1990

*Attest:*

HARRY F. MANBECK, JR.

*Attesting Officer*

*Commissioner of Patents and Trademarks*